US006450621B1

(12) United States Patent
Hayakawa

(10) Patent No.: US 6,450,621 B1
(45) Date of Patent: Sep. 17, 2002

(54) SEMICONDUCTOR DEVICE HAVING INKJET RECORDING CAPABILITY AND METHOD FOR MANUFACTURING THE SAME, INKJET HEAD USING SEMICONDUCTOR DEVICE, RECORDING APPARATUS, AND INFORMATION-PROCESSING SYSTEM

(75) Inventor: Yukihiro Hayakawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/391,061

(22) Filed: Sep. 16, 1999

(30) Foreign Application Priority Data

Sep. 17, 1998 (JP) ..... 10-263547

(51) Int. Cl.[7] ..... B41J 2/05
(52) U.S. Cl. ..... 347/63
(58) Field of Search ..... 347/63, 65, 67; 257/611, 617, 913; 438/471, 733, 745, 739, 753

(56) References Cited

U.S. PATENT DOCUMENTS

| | | | | |
|---|---|---|---|---|
| 4,597,804 A | * | 7/1986 | Imaoka | 148/1.5 |
| 5,327,007 A | * | 7/1994 | Imura et al. | 257/610 |
| 5,635,968 A | * | 6/1997 | Bhaskar et al. | 347/59 |
| 6,113,222 A | | 9/2000 | Ohkuma | 347/63 |
| 6,139,761 A | | 10/2000 | Ohkuma | 216/27 |
| 6,143,190 A | | 11/2000 | Yagi et al. | 216/27 |

FOREIGN PATENT DOCUMENTS

| | | | |
|---|---|---|---|
| JP | 3-50737 | 3/1991 | H01L/21/322 |
| JP | 10-181032 | 7/1998 | |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

The present invention provides a semiconductor device having an inkjet recording capability and a method of making such a device. The present invention also provides an inkjet head to which an inkjet recording mode for producing an output of information including characters and images is applicable, a recording apparatus on which such a recording head can be fixed or detachably installed, and an information-processing system having such a recording apparatus as its output member. In particular, the present invention relates to an inkjet recording head of the side-shooter type that ejects a droplet of recording liquid perpendicularly on a surface thereof where a plurality of elements for generating ejection-energies to be used for ejecting ink is formed. A semiconductor device with an inkjet recording capability has: a silicon substrate having a denuded zone (DZ) and a oxygen precipitate (OP) layer, where the OP layer contains oxygen precipitates (OPs); energy-generating elements for generating energies for ejecting ink, which are formed on the silicon substrate; ink-supplying openings provided as through-holes formed on the silicon substrate; ink-flow channels provided in a layer of forming flow channels being stacked on the silicon substrate, communicating with the ink-supplying openings and corresponding to the energy-generating elements, respectively; and ink-ejecting orifices provided in a layer of forming orifices being stacked on the layer of forming flow channels, communicating with the ink-flow channels, respectively.

20 Claims, 14 Drawing Sheets

IG TREATMENT

FORMING A SEMICONDUCTOR DEVICE ON THE SURFACE OF Si SUBSTRATE FOR INKJET DRIVE

PATTERNING OF INK-SUPPLYING OUTLET ON THE BACK OF Si SUBSTRATE

Si-ETCHING FROM THE BACK OF Si SUBSTRATE

SEMICONDUCTOR DEVICE HAVING INKJET RECORDING CAPABILITY AND METHOD FOR MANUFACTURING THE SAME, INKJET HEAD USING SEMICONDUCTOR DEVICE, RECORDING APPARATUS, AND INFORMATION-PROCESSING SYSTEM

This application is based on Japanese Patent Application No. 10-263547 (1998) filed Sep. 17, 1998, the content of which is incorporated hereinto by reference.

BACKGROUND OF THE INVENTION

1. Field of the Invention

The present invention relates to a semiconductor device having an inkjet recording capability and a method of making such a device. The present invention also relates to an inkjet head to which an inkjet recording mode for producing an output of information including characters and images is applicable, a recording apparatus on which such a recording head can be fixed or detachably installed, and an information-processing system having such a recording apparatus as its output means. In particular, the present invention relates to an inkjet recording head of the side-shooter type that ejects a droplet of recording liquid perpendicularly on a surface thereof where a plurality of elements for generating ejection-energies to be used for ejecting ink is formed.

2. Description of the Related Art

Commonly, an inkjet recording apparatus comprises: a carriage on which a recording means (hereinafter, also referred to as an inkjet head) and an ink-supplying means (e.g., an ink tank) for supplying a recording liquid (e.g., ink) to the recording means are installed; a transfer means for transferring a recording medium (hereinafter, also referred to as recording paper) such as paper, fabric, plastic sheet, and OHP sheet; and a control means for controlling the motion of those components. The inkjet head adapted to eject ink droplets from a plurality of ejection ports thereof is serially scanned in the direction (i.e., in the main-scanning direction) at a right angle relative to the direction of transferring the recording medium (i.e., in the sub-scanning direction), and subsequently, the recording medium is intermittently transferred at a quantity of displacement thereof equal to the recording width of the recording medium while no recording operation is performed. The inkjet head has elements that cause pressures for ejecting ink as means for generating energies to eject ink. That is, the means are electro-thermal energy converters that cause membrane-boiling phenomena in ink.

In general, there are two types of inkjet heads, i.e., an edge-shooter type and a side-shooter type. The edge-shooter type inkjet head has a plurality of ink-ejecting orifices, which is formed on an end portion of ink passage. That is, each of the orifices is in the downstream part of ink flow with respect to heater portions provided for heating ink. Ink passes through a plurality of ink-supplying paths branched from an ink-reservoir portion, so that each of the heater portions is provided in the corresponding ink-supplying path. On the other hand, each of the ink-ejecting orifices of the side-shooter type inkjet head is formed so as to face to the corresponding heater portion. That is, the side-shooter type inkjet head is prepared by forming a through hole (hereinafter, also referred to as an ink-supplying opening) on a substrate on which ink-ejecting energy generating elements are formed. The through hole provides the ink from the backside (i.e., the ink-supplying tank is arranged on the backside), while the ink is ejected from an orifice formed on a place in the direction perpendicular to the ink-ejecting energy generating element. The reason for supplying ink from the backside of the substrate is to make the distance between the inkjet head and the recording medium short. If the ink is supplied from the side on which the ink-ejecting energy generating element is formed, the distance between the inkjet head and the recording medium can be increased because of the presence of the ink-supplying tank.

The ink-supplying opening is formed by the method of making semiconductor integrated circuits (i.e., the process of semiconductor photolithography) using a single crystal silicon substrate (hereinafter, referred to as a Si substrate). For example, the ink-supplying opening is formed as a through hole by performing an anisotropic etching from the back side of the Si substrate.

However, the process of forming the above ink-supplying opening has the following problems.

FIGS. 1A to 1D are schematic cross sectional views for explaining the process of forming the conventional ink-supplying opening and each of them corresponds to each of the steps in the process. The figures focus attention on oxygen precipitates 5, 6, 7 in a Si substrate and a plurality of ink-supplying openings 8*a*, 8*b*, 8*c*. As shown in the figures, the precipitates are indicated by different numerals because they are different in size and density. That is, the oxygen precipitate 5 shows the highest density and the smallest size. The oxygen precipitate 6 shows the medium density and the medium size. The oxygen precipitate 7 shows the lowest density and the smallest size. The process includes the steps of: (a) preparing a silicon (Si) substrate: (b) forming a semiconductor device for inkjet-drive on the surface of the substrate; (c) forming a pattern of ink-supplying opening on the back of the substrate; and (D) performing an anisotropic etching from the back of the substrate. As shown in FIG. 1D, however, defectives (oxygen precipitate) with nonuniform sizes and densities are generated as a result of variations in concentrations of Oi (interstitial oxygen atoms) in the Si substrates after the step of crystal-pulling and variations in nonuniform thermal applications during the formation of semiconductor device among wafers and in each of them. Consequently, the rate of anisotropic etching on the Si substrate is not constant because of the presence of the above defectives, resulting in variations in sizes of the completed ink-supplying openings formed by the Si anisotropic etching. Regarding the variations in sizes of the ink-supplying openings 8*a*, 8*b*, 8*c*, therefore, the difference between the maximum and minimum opening widths is in the range of 40 to 60 $\mu$m in one wafer and in the range of 100 to 150 $\mu$m among the wafers.

FIGS. 2A and 2B are schematic plane views for explaining the conditions of ink-supplying openings formed by the above conventional method. The figures focus attention on one ink-supplying opening for purposes of simple illustration. FIG. 2A shows the condition of the surface of the Si substrate 1, while FIG. 2B shows the condition of the back of the Si substrate 1. In the ink-supplying opening 8*b*, an opening width of an opening portion 9 on the surface of the Si substrate 1 is different from an opening width of an opening portion 10 on the back of the Si substrate 1. In FIG. 2A, furthermore, the shape of the opening portion 9 of the ink-supplying opening 8*b* prepared by performing an anisotropic etching on the back of the Si substrate 1 is different from the shape of an opening portion 11 having an ideal opening size to be calculated from a mask size.

Variations in the shape of opening portion 9 on the side of semiconductor device having an inkjet recording capability leads to variations of the distances between the ink-supplying orifices and the ejection-energy generating portions (not shown) and significantly effects on the characteristics of operating frequencies of the inkjet head.

However, it is impossible to get an appropriate size of the etching mask 3 for etching the back of the Si substrate to satisfy an appropriate opening width of ink-supplying opening in consideration of those variations. Consequently, as shown in FIG. 1D, there are different openings. The ink-supplying opening 8*b* with an appropriate opening width, the ink-supplying opening 8*a* with a less opening width, and the ink-supplying opening 8*c* with no opening width on the surface of the Si substrate.

Therefore, there are demands for technological breakthroughs in the process of forming an ink-supplying opening with the more precise distance between the ink-supplying opening and the ink-ejection energy generating element by forming an ink-supplying opening more precisely.

SUMMARY OF THE INVENTION

It is therefore an object of the present invention is to provide a semiconductor device having an inkjet recording capability and a method of making such a device;

It is another object of the present invention is to provide a an inkjet head to which an inkjet recording mode for producing an output of information including characters and images is applicable, where a semiconductor device having an inkjet recording capability is used in the inkjet head. It is a further object of the present invention is to provide a recording apparatus on which such a recording head can be fixed or detachably installed, and an information-processing system having such a recording apparatus as its output means.

In the first aspect of the present invention, there is provided a semiconductor device having an inkjet recording capability, comprising:

a silicon substrate having a denuded zone (DZ) and a oxygen precipitate (OP) layer, where the OP layer contains oxygen precipitates (OPs);

energy-generating elements for generating energies for ejecting ink, which are formed on the silicon substrate;

ink-supplying openings provided as through-holes formed on the silicon substrate;

ink-flow channels provided in a layer of forming flow channels being stacked on the silicon substrate, communicating with the ink-supplying openings and corresponding to the energy-generating elements, respectively; and ink-ejecting orifices provided in a layer of forming orifices being stacked on the layer of forming flow channels, communicating with the ink-flow channels, respectively.

Here, the denuded zone (DZ) may be separated as two DZ portions, where one is provided as a surface portion of the silicon substrate and the other is provided as a back portion of the silicon substrate and each of them has a thickness of 30 to 150 $\mu$m.

A density of defects caused by the oxygen precipitates (OPs) in the OP layer may be $5\times10^{8}$ to $1\times10^{10}$ $cm^{-3}$.

A size of each of the defects caused by the oxygen precipitates (OPs) in the OP layer may be 50 $\mu$m or less.

The denuded zone (DZ) may be formed by performing at least a step of high-temperature treatment in an intrinsic-gettering (IG) treatment process having the steps of high-temperature treatment and low-temperature treatment on the Si substrate.

The step of high-temperature treatment may include a high-temperature treatment at a temperature of 1,100° C. to 1,200° C.

The Si substrate may be given the low-temperature treatment of the process of intrinsic-gettering (IG) treatment.

The step of the low temperature treatment may be performed at a temperature of 650° C. to 850° C.

The ink-ejecting energy generating element may be an electrothermal energy converting element which can cause film boiling of the ink.

In the second aspect of the present invention, there is provided an inkjet head comprising a semiconductor device having an inkjet recording capability, wherein the semiconductor device comprises:

a silicon substrate having a denuded zone (DZ) and a oxygen precipitate (OP) layer, where the OP layer contains oxygen precipitates (OPs);

energy-generating elements for generating energies for ejecting ink, which are formed on the silicon substrate;

ink-supplying openings provided as through-holes formed on the silicon substrate;

ink-flow channels provided in a layer of forming flow channels being stacked on the silicon substrate, communicating with the ink-supplying openings and corresponding to the energy-generating elements, respectively; and ink-ejecting orifices provided in a layer of forming orifices being stacked on the layer of forming flow channels, communicating with the ink-flow channels, respectively.

Here, the denuded zone (DZ) may be separated as two DZ portions, where one is provided as a surface portion of the silicon substrate and the other is provided as a back portion of the silicon substrate and each of them has a thickness of 30 to 150 $\mu$m.

A density of defects caused by the oxygen precipitates (OPs) in the OP layer may be $5\times10^{8}$ to $1\times10^{10}$ $cm^{-3}$.

A size of each of the defects caused by the oxygen precipitates (OPs) in the OP layer may be 50 $\mu$m or less.

The denuded zone (DZ) may be formed by performing at least a step of high-temperature treatment in an intrinsic-gettering (IG) treatment process having the steps of high-temperature treatment and low-temperature treatment on the Si substrate.

The step of high-temperature treatment may include a high-temperature treatment at a temperature of 1,100° C. to 1,200° C.

The Si substrate may be given the low-temperature treatment of the process of intrinsic-gettering (IG) treatment.

The step of the low temperature treatment may be performed at a temperature of 650° C. to 850° C.

The ink-ejecting energy generating element may be an electrothermal energy converting element which can cause film boiling of the ink.

In the third aspect of the present invention, there is provided an inkjet recording apparatus, comprising:

a means on which an inkjet head having a semiconductor device with an inkjet recording capability is detachably installed or fixed, wherein the semiconductor device includes:

a silicon substrate having a denuded zone (DZ) and a oxygen precipitate (OP) layer, where the OP layer contains oxygen precipitates (OPs);

energy-generating elements for generating energies for ejecting ink, which are formed on the silicon substrate;

ink-supplying openings provided as through-holes formed on the silicon substrate;

ink-flow channels provided in a layer of forming flow channels being stacked on the silicon substrate, communicating with the ink-supplying openings and corresponding to the energy-generating elements, respectively; and ink-ejecting orifices provided in a layer of forming orifices being stacked on the layer of forming flow channels, communicating with the ink-flow channels, respectively.

In the fourth aspect of the present invention, there is provided an information-processing system, comprising:

at least an output means and a control means for controlling an operation of the output means, where the output means is an inkjet recording apparatus having a means on which an inkjet head having a semiconductor device with an inkjet recording capability is detachably installed or fixed, wherein the semiconductor device includes:

a silicon substrate having a denuded zone (DZ) and a oxygen precipitate (OP) layer, where the OP layer contains oxygen precipitates (OPs);

energy-generating elements for generating energies for ejecting ink, which are formed on the silicon substrate;

ink-supplying openings provided as through-holes formed on the silicon substrate;

ink-flow channels provided in a layer of forming flow channels being stacked on the silicon substrate, communicating with the ink-supplying openings and corresponding to the energy-generating elements, respectively; and ink-ejecting orifices provided in a layer of forming orifices being stacked on the layer of forming flow channels, communicating with the ink-flow channels, respectively.

Here, the information-processing system may be selected from the group consisting of: copying machines, facsimile machines, printers, word processors, personal computers, and textile printing apparatuses.

In the fifth aspect of the present invention, there is provided a method of manufacturing a semiconductor device having an inkjet recording capability, comprising the steps of:

forming a silicon substrate having a denuded zone (DZ) and a oxygen precipitate (OP) layer, where the OP layer contains oxygen precipitates (OPs);

providing the silicon substrate with energy-generating elements for generating energies for ejecting ink;

forming through-holes as ink-supplying openings on the silicon substrate;

stacking a flow-channel forming layer on the silicon substrate to form ink-flow channels that respectively communicate with ink-supplying orifices and respectively and correspond to the energy-generating elements; and stacking an orifice forming layer on the flow-channel forming layer to form ink-ejecting orifices that respectively communicate with the ink-flow channels.

Here, the denuded zone (DZ) may be separated as two DZ portions, where one is provided as a surface portion of the silicon substrate and the other is provided as a back portion of the silicon substrate and each of them has a thickness of 30 to 150 $\mu$m.

A density of defects caused by the oxygen precipitates (OPs) in the OP layer may be $5\times10^{8}$ to $1\times10^{10}$ $cm^{-3}$.

A size of each of the defects caused by the oxygen precipitates (OPs) in the OP layer may be 50 $\mu$m or less.

The denuded zone (DZ) may be formed by performing at least a step of high-temperature treatment in an intrinsic-gettering (IG) treatment process having the steps of high-temperature treatment and low-temperature treatment on the Si substrate.

The step of high-temperature treatment may include a high-temperature treatment at a temperature of 1,100° C. to 1,200° C.

The Si substrate may be given the low-temperature treatment of the process of intrinsic-gettering (IG) treatment.

The step of the low temperature treatment may be performed at a temperature of 650° C. to 850° C.

The ink-ejecting energy generating element may be an electrothermal energy converting element which can cause film boiling of the ink.

In the sixth aspect of the present invention, there is provided a semiconductor substrate to be used in a semiconductor device having an inkjet recording capability, comprising:

a silicon substrate having a denuded zone (DZ) and a oxygen precipitate (OP) layer, where the OP layer contains oxygen precipitates (OPs);

energy-generating elements for generating energies for ejecting ink, which are formed on the silicon substrate; and ink-supplying openings provided as through-holes formed on the silicon substrate.

The above and other objects, effects, features and advantages of the present invention will become more apparent from the following description of the embodiments thereof taken in conjunction with the accompanying drawings.

BRIEF DESCRIPTION OF THE DRAWINGS

FIG. 2A is a plan view of the ink-supplying opening on the surface of a silicon (Si) substrate and FIG. 2B is a plan view of the ink-supplying opening on the back of the Si substrate;

FIG. 4A is a plan view of the ink-supplying opening on the surface of a silicon (Si) substrate and FIG. 4B is a plan view of the ink-supplying opening on the back of the Si substrate;

DETAILED DESCRIPTION OF PREFERRED EMBODIMENTS

Figure 1A:
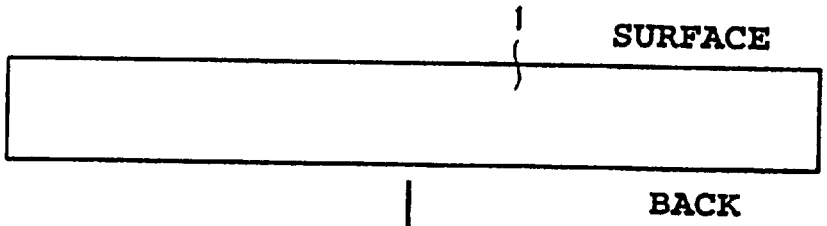
FIG. 1A PRIOR ART
FIG. 1A to FIG. 1D are schematic cross sectional views that illustrate the process of forming an ink-supplying opening on a semiconductor device which can be adaptable to the conventional inkjet head, where each of the figures corresponds to each of the steps, respectively.
Figure 1B:
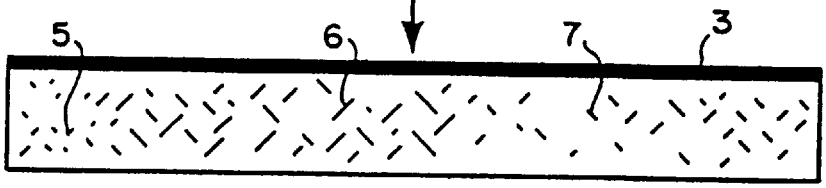
FIG. 1B PRIOR ART
Figure 1C:
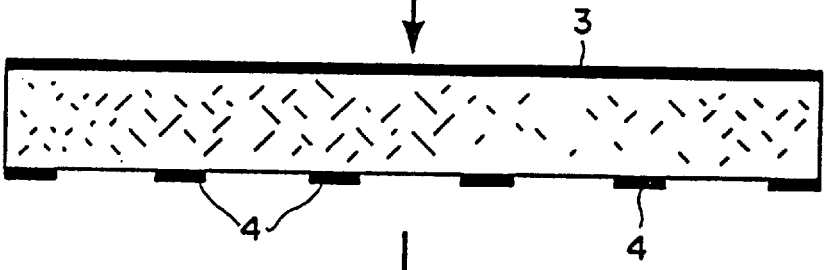
FIG. 1C PRIOR ART
Figure 1D:
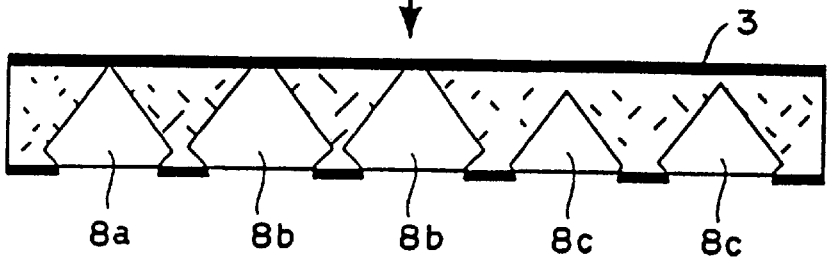
FIG. 1D PRIOR ART
Figure 2A:
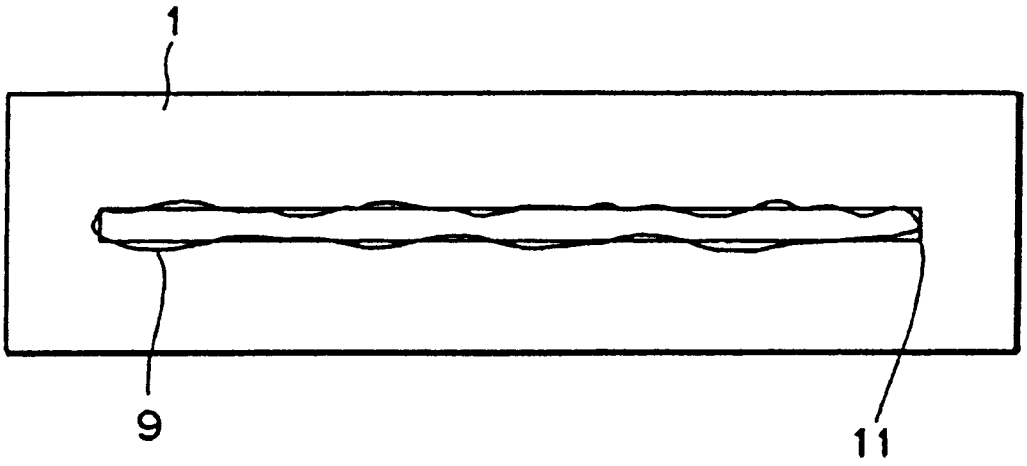
FIG. 2A PRIOR ART
FIG. 2A and FIG. 2B illustrate the opening accuracy of the ink-supplying opening formed according to the process shown in FIG. 1A to FIG. 1D, where
Figure 2B:
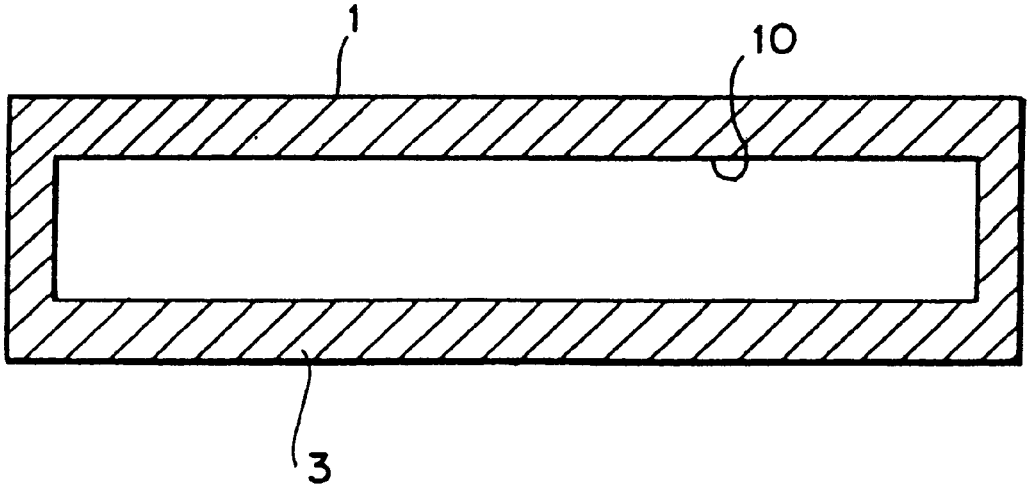
FIG. 2B PRIOR ART

According to the present invention, a semiconductor device having an inkjet recording capability is characterized by the homogeneous distribution of defective portions in silicon (Si) substrate by correctly making the size and density of each defective portion using the process of intrinsic gettering. For performing an anisotropic etching from the back side of the Si substrate, it allows to work around the problem of the variations in widths of ink-supplying openings resulting from different sizes and densities of the defective portions in the Si substrate.

FIGS. 3A to 3E are schematic cross-sectional views for illustrating the steps in the process of forming ink-supplying opening on a semiconductor device applicable to an inkjet head in accordance with the present invention, respectively. Reference numeral 1 denotes a silicon (Si) substrate, 2 denotes an oxygen precipitate (or impurities and crystal defectives), each of 3 and 4 denotes a masking material for anisotropic etching; and 8 denotes an ink-supplying opening.

Figure 3A:
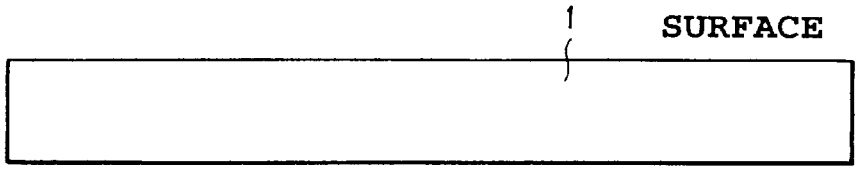
FIG. 3A to FIG. 3E are schematic cross sectional views that illustrate the process of forming an ink-supplying opening on a semiconductor device which can be adaptable to an inkjet head in accordance with the present invention, where each of the figures corresponds to each of the steps, respectively.
Figure 3B:
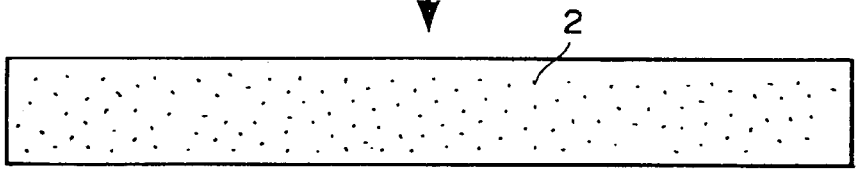
Figure 3C:
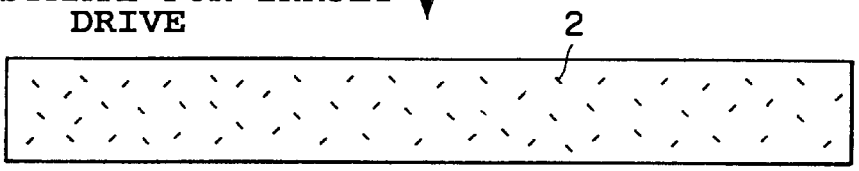
Figure 3D:
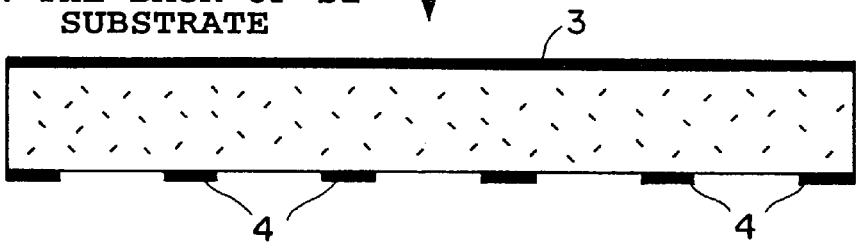

As shown in the figures, the process includes the steps of:

(i) preparing a silicon (Si) substrate to be subjected to the following steps (FIG. 3A);

(ii) performing an intrinsic gettering (IG) treatment on the Si substrate 1 (FIG. 3B);

(iii) applying a masking material on both sides of the Si substrate 1 and forming a semiconductor device (not shown) for inkjet drive on the surface of the Si substrate 1 (FIG. 3C);

(iv) forming a pattern of ink-supplying opening on the back of the substrate (FIG. 3D); and.

Figure 3E:
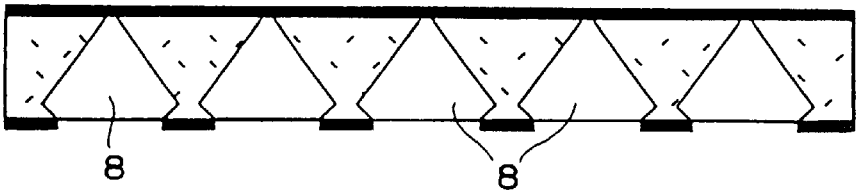

(v) performing a Si anisotropic etching on the Si substrate 1 from the back thereof (FIG. 3E).

We are now explaining the IG treatment in brief. In the semiconductor manufacturing process, the reduction in contaminated impurities has been progressed as a result of increasing the level of cleaning technology. On the other hand, the demands for the physical or chemical conditions of contaminated impurities have been also increased as the technology of micro-machining the device has been developed. Furthermore, the risk of subjecting to various contaminated impurities is also increased because the device process becomes more complicated. Therefore, the IG treatment is one of the strategies for capturing the impurities passing through the cleaned process.

The IG treatment includes the formation of a getter-sink in the interior of a silicon crystal by appropriately subjecting the crystal under heat. The getter-sink traps contaminated impurities being entered into the crystal. In this case, the getter-sink uses a distortion area of oxygen precipitate. For forming the oxygen precipitate, the following steps of heat treatment can be required.

That is, the first thermal treatment includes the step of subjecting a silicon (Si) crystal wafer to heat at a temperature of 1,100 to 1,200° C. under an inert gas atmosphere to outwardly diffuse interstitial oxygen atoms (Oi) in a device-activating area in proximity of the surface of the Si wafer.

The second thermal treatment includes the step of generating a nucleus of oxygen precipitate at a temperature of 700 to 800° C.

The third thermal treatment includes the step of further growing the nucleus at a temperature of 900 to 1,200° C.

A series of the above thermal treatments makes the Si crystal wafer so as to have a cross-sectional structure thereof where a denuded zone (DZ) layer without any oxygen precipitate in proximity of the surface of the crystal and oxygen precipitate are present in the inside thereof.

In the IG treatment, by the way, the above thermal treatments may be optimally modified to design DZ width, size and density of the oxygen precipitate, and so on.

The present invention studies the conditions of thermal treatments corresponding to the above second and third stages and uses such conditions as means for obtaining an ink-supplying opening with precision by etching the Si substrate from the backside.

The etching for the Si substrate is an orientation-dependent anisotropic etching that utilizes one of etching solution such as KOH, TMAH(Tetramethyl ammoniumhydroxide solution), and hydrazine that cause variations in the etching rates depending on the crystal face.

The rate of anisotropic etching on the Si substrate is comparatively slow. If a 5-inch-diameter Si wafer is etched with TMAH, for example, it takes 20 hours or more for etching through the substrate of 625 $\mu$m in thickness. Therefore, the rate of anisotropic etching is varied if the defects are roughly distributed in the substrate. The presence or absence of the defects effects on the etching rate during a long-duration etching, so that the time that the etching reaches the surface of the wafer is varied. Consequently, it results in the difference between the shape of an ink-supplying opening formed on the surface of the wafer and the shape of a pattern defined on the back of the wafer. Thus, we cannot obtain the desired shape of the ink-supplying opening on the surface of the wafer. It is noted that the dimensions of chip is also an important factor for obtaining appropriately-etched portions because a considerably large sized pattern of ink-supplying openings is formed as a single distinct pattern on almost whole of the surface of one chip, which can be out of common sense of the semiconductor technologies. More specifically, the pattern is of a considerably narrow piece with about 100 μm in width and about 5 mm to 25 mm in length. That is, different shaped openings can be easily formed as a result of the variations in the etching rates in the same pattern if the etching is evenly proceeded through out a wide area to form a long pattern. For performing a long-duration etching and forming a large-sized pattern, there is a need to perform anisotropic etching uniformly on a single chip, a single wafer, or plural chips or wafers by uniformly forming the same sized defects in a horizontal and vertical directions by means of IG technology as described herein before manufacturing a semiconductor element.

As described above, the IC technology under the favorable conditions is required because of its steps different from those of the process of ordinarily manufacturing a semiconductor device. The IC technology includes the step of forming an ink-supplying opening from the back by an anisotropic etching.

The oxygen precipitate (and impurities or crystal defectives which are gettered by the oxygen precipitate) 2 in the interior of the semiconductor device are evenly distributed in almost the same size, so that an ink-supplying opening 8 can be uniformly formed in the surface of a wafer.

Figure 4A:
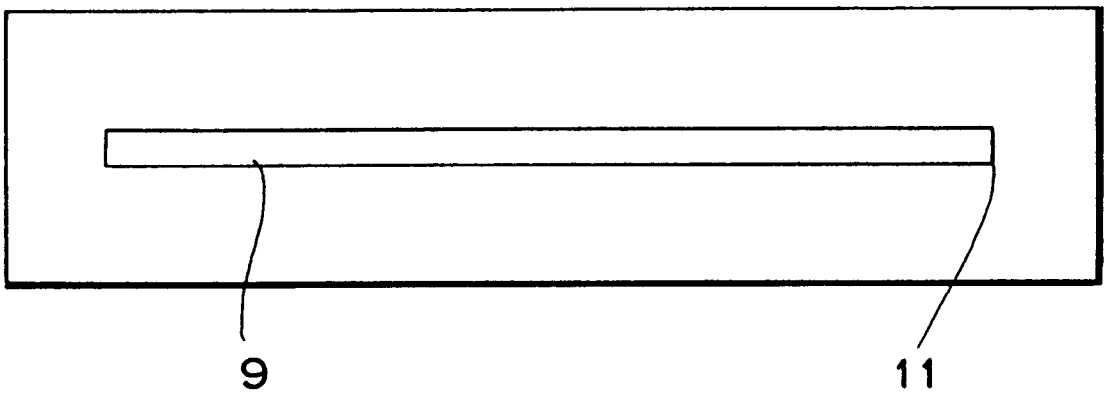
FIG. 4A and FIG. 4B illustrate the opening accuracy of the ink-supplying opening formed according to the process shown in FIG. 3A to FIG. 3D, where
Figure 4B:
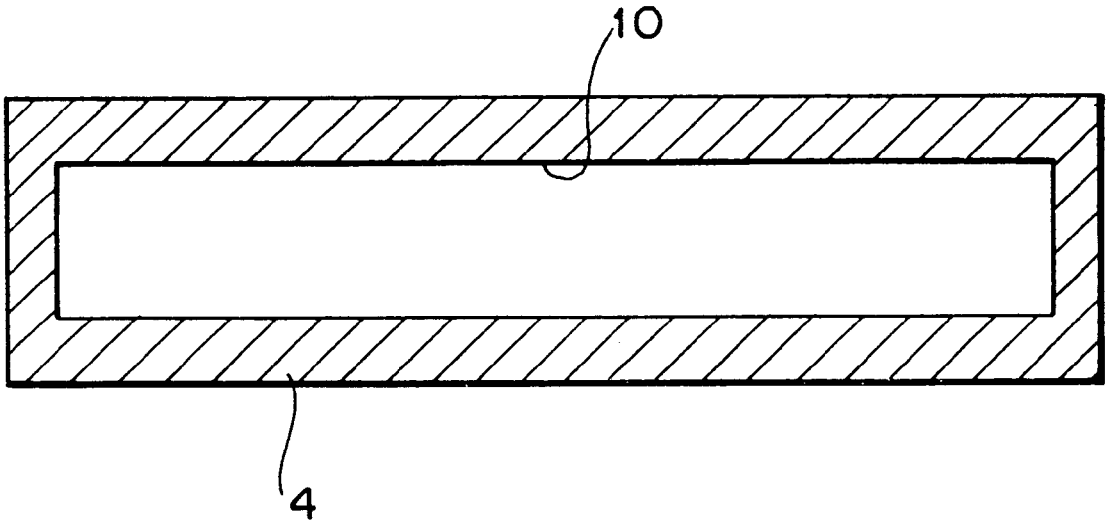

FIGS. 4A and 4B are schematic plan views for explaining the conditions of ink-supplying openings formed by the process represented in FIGS. 3A to 3E with an intrinsic-gettering (IG) treatment in accordance with the present invention. The figures focus attention on one ink-supplying opening for purposes of simple illustration. FIG. 4A shows the condition of the surface of the Si substrate 1, while FIG. 4B shows the condition of the back of the Si substrate 1. In the ink-supplying opening 8, an opening width of an opening portion 9 on the surface of the Si substrate 1 is different from an opening width of an opening portion 10 on the back of the Si substrate 1. In FIG. 4A, furthermore, the shape of the opening portion 9 of the ink-supplying opening 8 prepared by performing an anisotropic etching on the back of the Si substrate 1 is substantially the same as that of an opening portion 11 having an ideal opening size to be calculated from a mask size. As a result, improvements in the accuracy of opening width of the ink-supplying opening and an operating frequency of the inkjet head.

Figure 14:
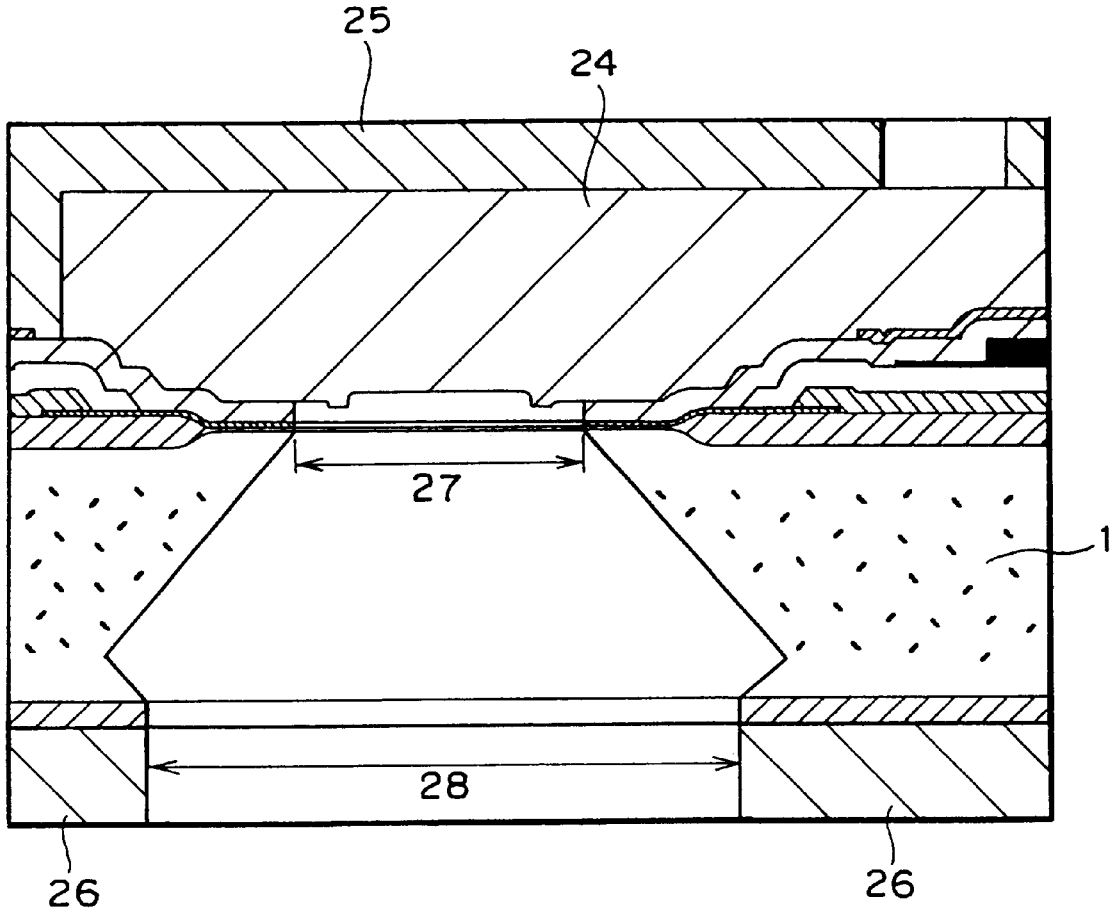
FIG. 14 is a schematic cross sectional view of a semiconductor device for explaining one of the steps in the process of manufacturing a semiconductor device adaptable to an inkjet head of the present invention.
Figure 15:
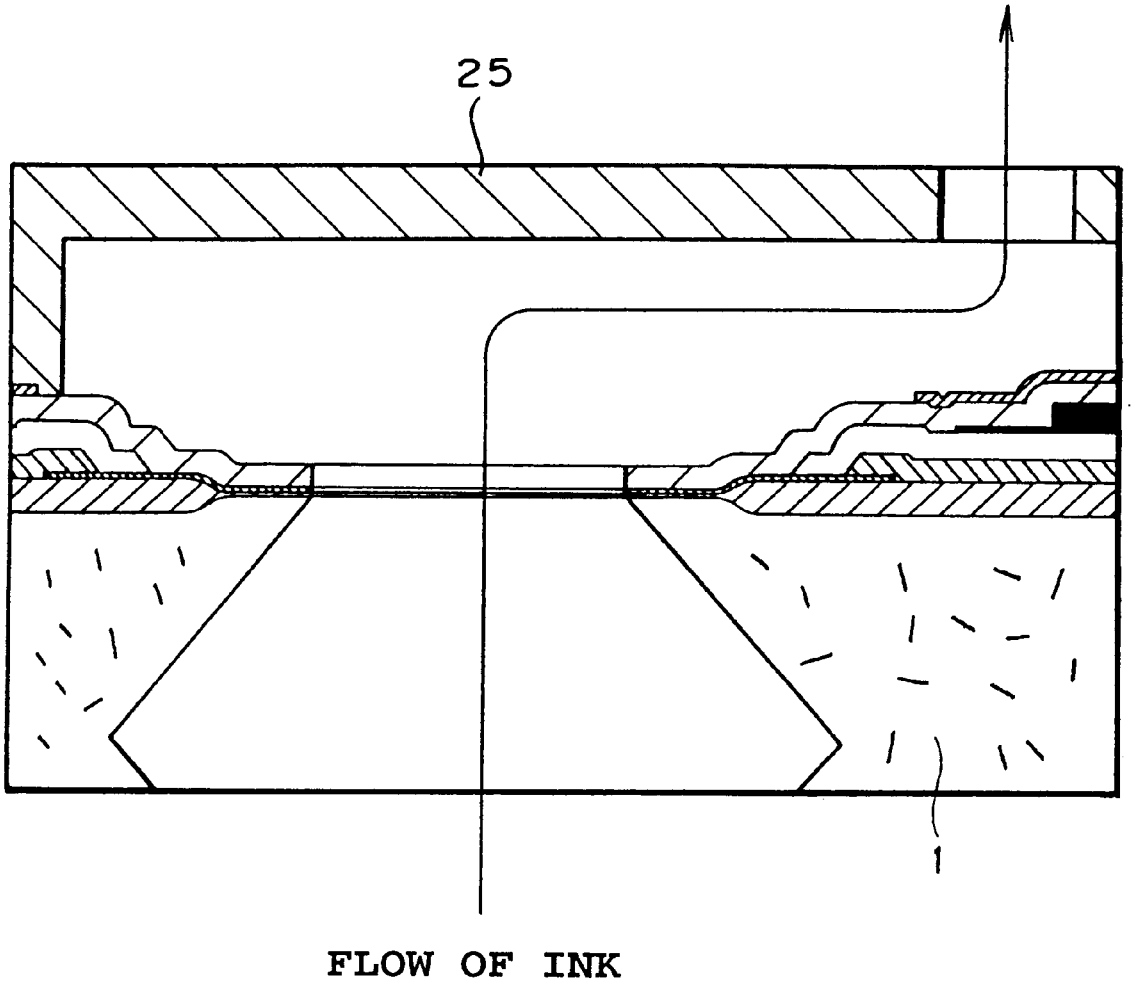
FIG. 15 is a schematic cross sectional view of a semiconductor device for explaining one of the steps in the process of manufacturing a semiconductor device adaptable to an inkjet head of the present invention.

A configuration of the semiconductor device to be applied on an inkjet type liquid-ejecting head and a method of manufacturing such a head in accordance with the present invention will be described in detail with reference to FIG. 5 to FIG. 15. These figures correspond to the respective steps of the process of manufacturing the above semiconductor device. In these figures, FIG. 14 and FIG. 15 illustrates a semiconductor device portion simultaneously formed with an ink-supplying portion and include a nozzle-forming portion and other figures illustrate only ink-supplying opening and its peripheral portion for the brief explanation.

Figure 5:
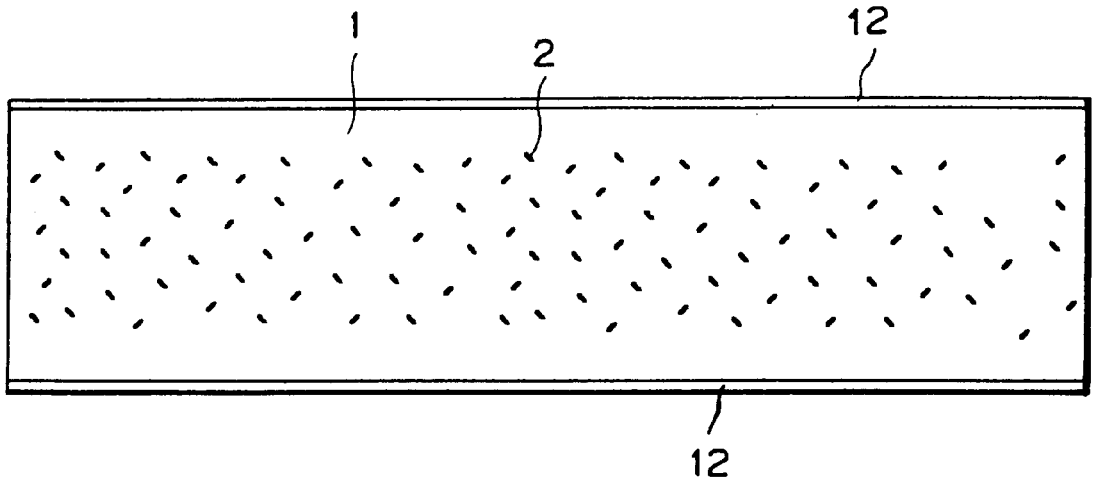
FIG. 5 is a schematic cross sectional view of a semiconductor device for explaining one of the steps in the process of manufacturing a semiconductor device adaptable to an inkjet head of the present invention.

(1) First of all, a silicon wafer with a crystal orientation of <1, 0, 0> and 625 μm in thickness is prepared as a P-type silicon (Si) substrate 1. Then, the Si substrate 1 is heated at a temperature of 1,100 to 1,200° C. and a silicon oxide membrane 12 is formed on the surface of the Si substrate 1. Simultaneously, interstitial oxygen atoms in a device-activating region near the surface are dispersed outwardly (FIG. 5). Consequently, a denuded zone (DZ) of 30 to 150 μm in width without any oxygen precipitate in the vicinity of the surface.

(2) By performing a thermal treatment of 650 to 850° C. (simultaneously with the Si-thermal oxidation step at a temperature of about 1,000 to 7,000 Å), oxygen precipitate 2 in the Si substrate 1 is subjected to nucleation and growth. In FIG. 5 to FIG. 14, the oxygen precipitate 2 is illustrated. In FIG. 15, on the other hand, the oxygen precipitate 2 is not illustrated in spite of their presence.

Figure 6:
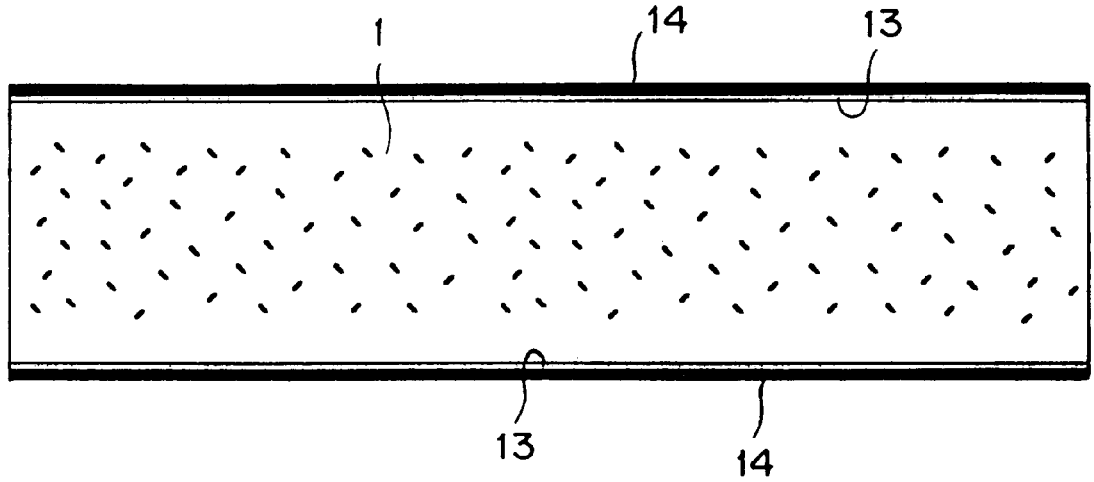
FIG. 6 is a schematic cross sectional view of a semiconductor device for explaining one of the steps in the process of manufacturing a semiconductor device adaptable to an inkjet head of the present invention.

(3) After-removing the thermal oxidation membrane 12 by the HF treatment, a silicon oxide membrane 13 of 100 to 500 Å in thickness is formed on the Si substrate 1 by performing a thermal oxidation one more at a temperature of 100 to 500° C. A silicon nitride membrane 14 is also formed on the silicon oxide membrane 13 by a reduced pressure CVD of 1,000 to 3,000 Å (FIG. 6).

Figure 7:
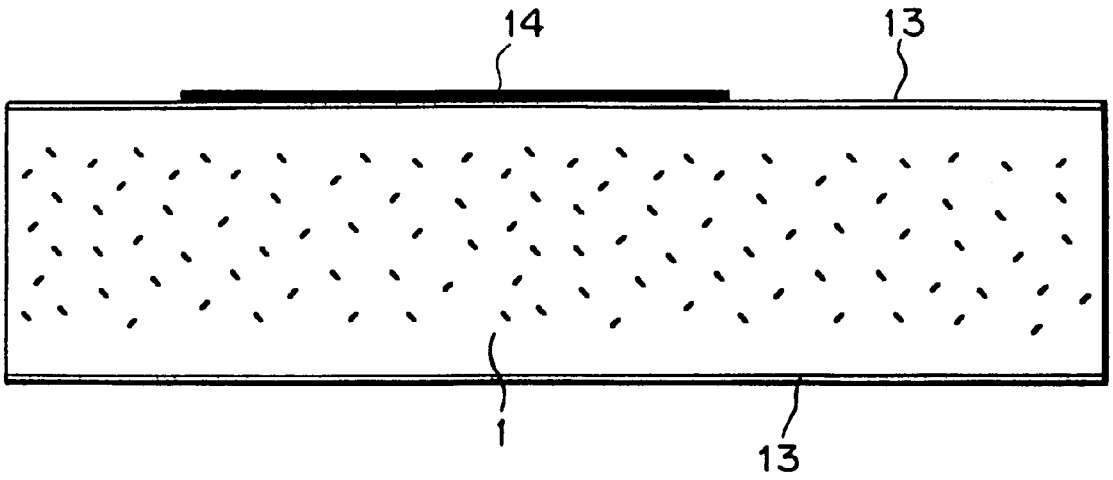
FIG. 7 is a schematic cross sectional view of a semiconductor device for explaining one of the steps in the process of manufacturing a semiconductor device adaptable to an inkjet head of the present invention.

(4) The silicon nitride membrane 14 is processed into a predetermined pattern (FIG. 7). Then, the silicon nitride membrane on the back of the Si substrate is removed.

Figure 8:
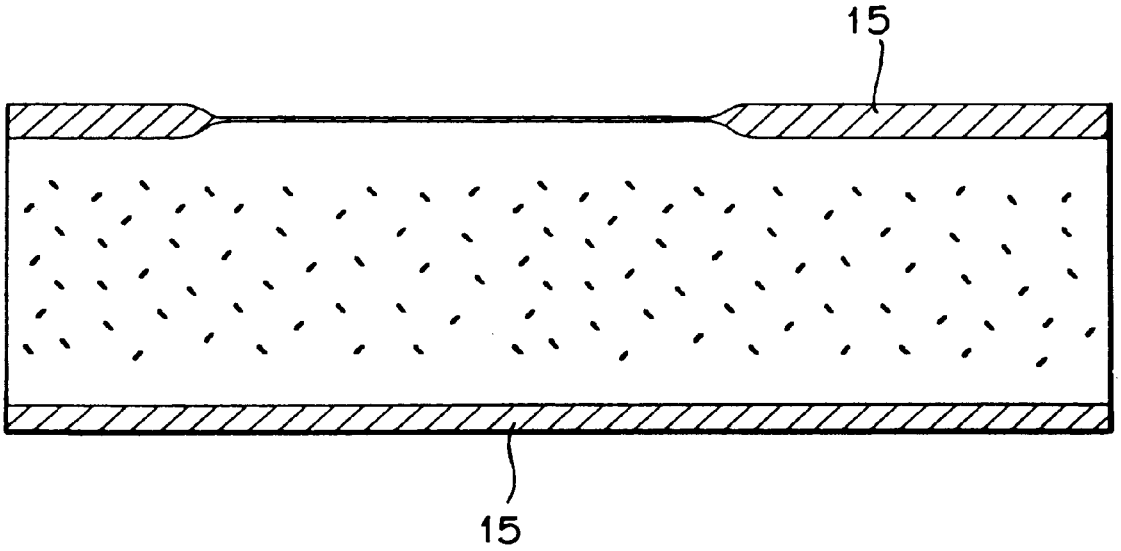
FIG. 8 is a schematic cross sectional view of a semiconductor device for explaining one of the steps in the process of manufacturing a semiconductor device adaptable to an inkjet head of the present invention.

(5) A silicon oxide membrane 15 of 6,000 to 12,000 Å in thickness is formed on the Si substrate by performing a silicon thermal oxidation. In this case, the silicon oxide membrane 13 under the patterned thermal silicon nitride membrane 14 is not oxidized. Both ends of the oxide membrane are selectively oxidized (FIG. 8).

(6) A part of the portion (active region) under the silicon nitride membrane 14 is subjected to patterning and etching and also a poly-Si membrane 16 (to be provided as a sacrifice layer) is formed by the reduced pressure CVD and then subjected to patterning and etching. The sacrifice layer is responsible for forming an ink-supplying opening with a high degree of precision at a step afterward.

Figure 9:
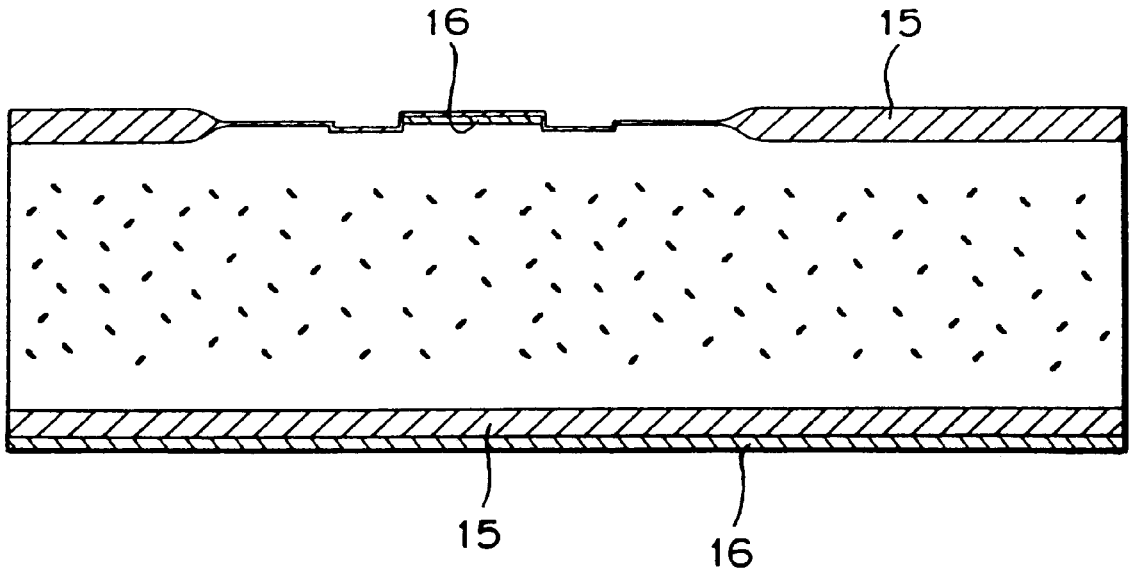
FIG. 9 is a schematic cross sectional view of a semiconductor device for explaining one of the steps in the process of manufacturing a semiconductor device adaptable to an inkjet head of the present invention.

(7) After etching the poly-Si sacrifice layer, the top surface is subjected to a silicon thermal oxidation to form a silicon oxide membrane (200 to 1,000 Å) (FIG. 9).

Figure 10:
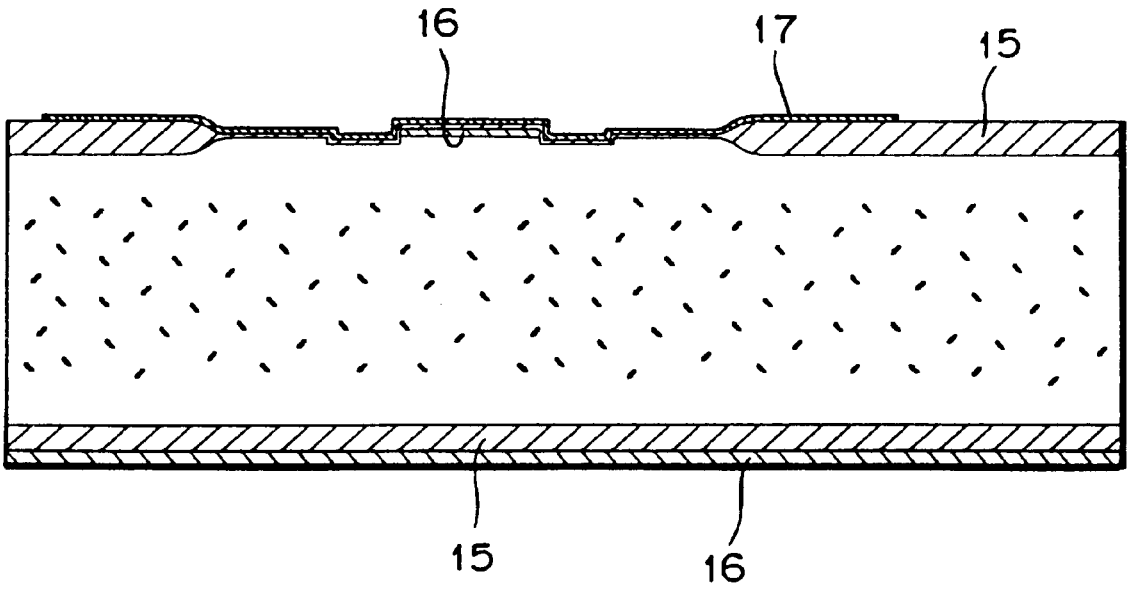
FIG. 10 is a schematic cross sectional view of a semiconductor device for explaining one of the steps in the process of manufacturing a semiconductor device adaptable to an inkjet head of the present invention.

(8) Then, a silicon nitride membrane 17 of 500 to 4,000 Å in thickness is formed by the reduced pressure CVD and then subjected to patterning to make a predetermined pattern (FIG. 10).

Figure 11:
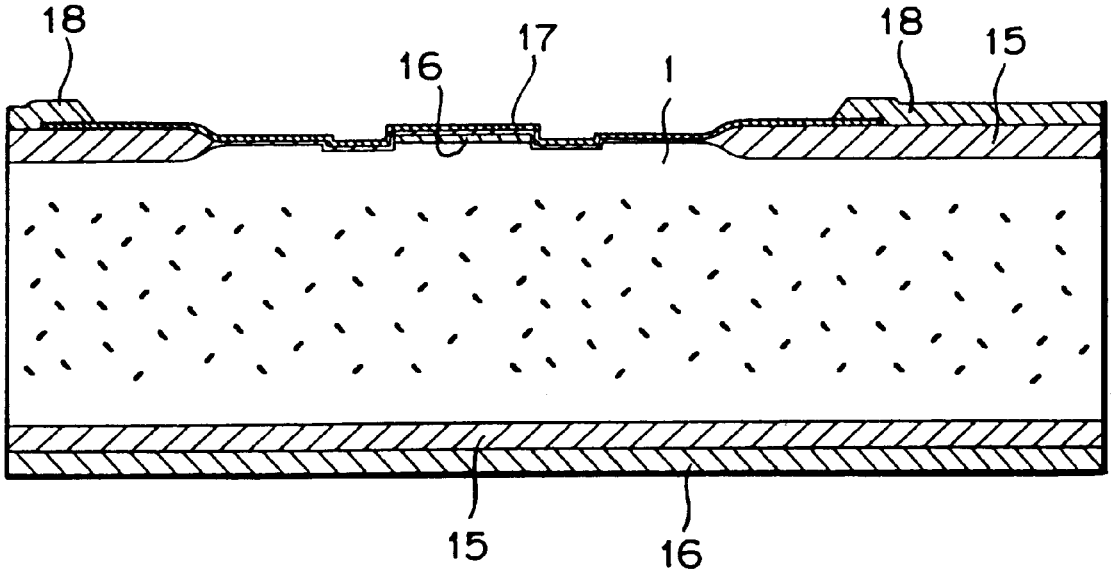
FIG. 11 is a schematic cross sectional view of a semiconductor device for explaining one of the steps in the process of manufacturing a semiconductor device adaptable to an inkjet head of the present invention.

(9) A PSG membrane 18 of 5,000 to 10,000 A in thickness to be provided as an inter layer membrane to a wiring electrode is formed and then subjected to patterning to make a predetermined pattern. Furthermore, an AL—Cu membrane (not shown) to be provided as the wiring electrode is formed and then subjected to patterning to make a predetermined pattern (FIG. 11).

Figure 12:
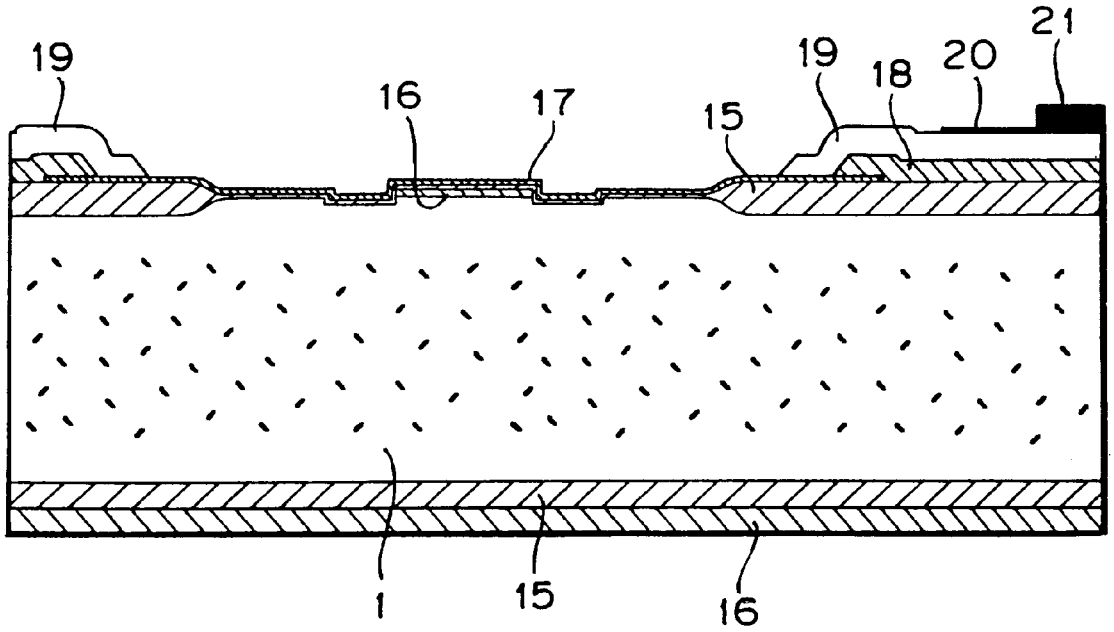
FIG. 12 is a schematic cross sectional view of the semiconductor device for explaining one of the steps in the process of manufacturing a semiconductor device adaptable to an inkjet head of the present invention.

(10) As shown in FIG. 12, subsequently, a plasma oxidation membrane 19 of 8,000 to 18,000 Å in thickness is formed by plasma CVD and then subjected to patterning to form a predetermined pattern. Furthermore, TaN to be provided as a thermal resistor 20 of 200 to 1,000 Å in thickness on the plasma oxidation membrane 19 by a reactive sputtering method and then subjected to patterning to make a predetermined pattern. Furthermore, an Al—Cu membrane 21 as a wiring electrode of the thermal resister 20 is formed thereon and then subjected to patterning to make a predetermined pattern.

Figure 13A:
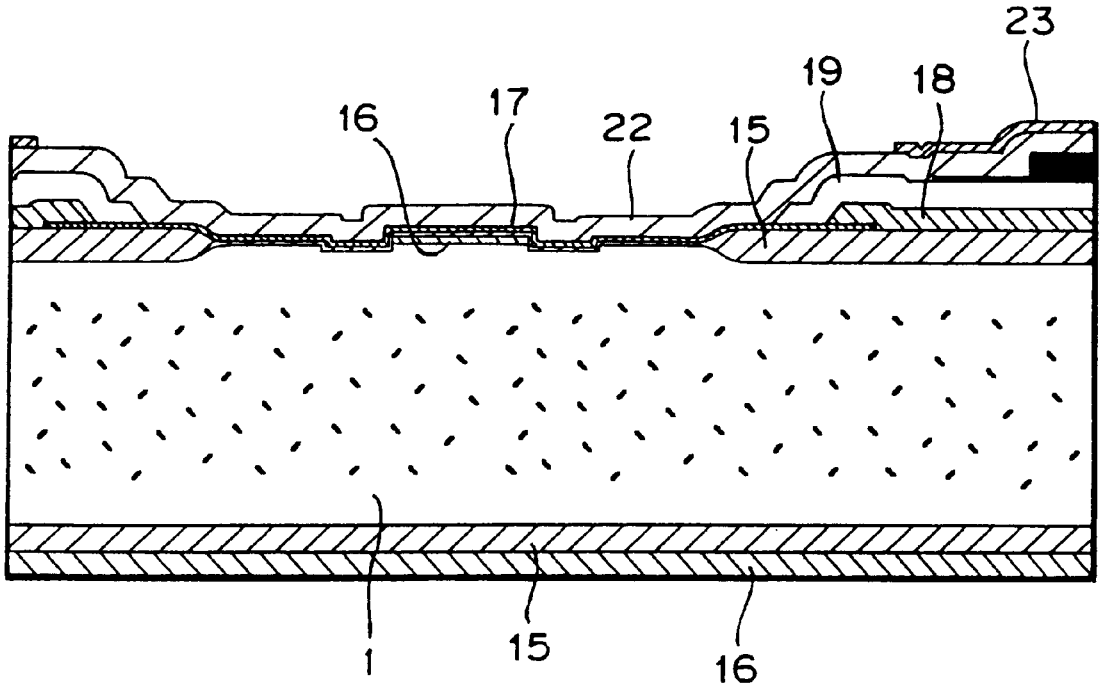
FIG. 13A is a schematic cross sectional view of a semiconductor device for explaining one of the steps in the process of manufacturing a semiconductor device adaptable to an inkjet head of the present invention.
Figure 13B:
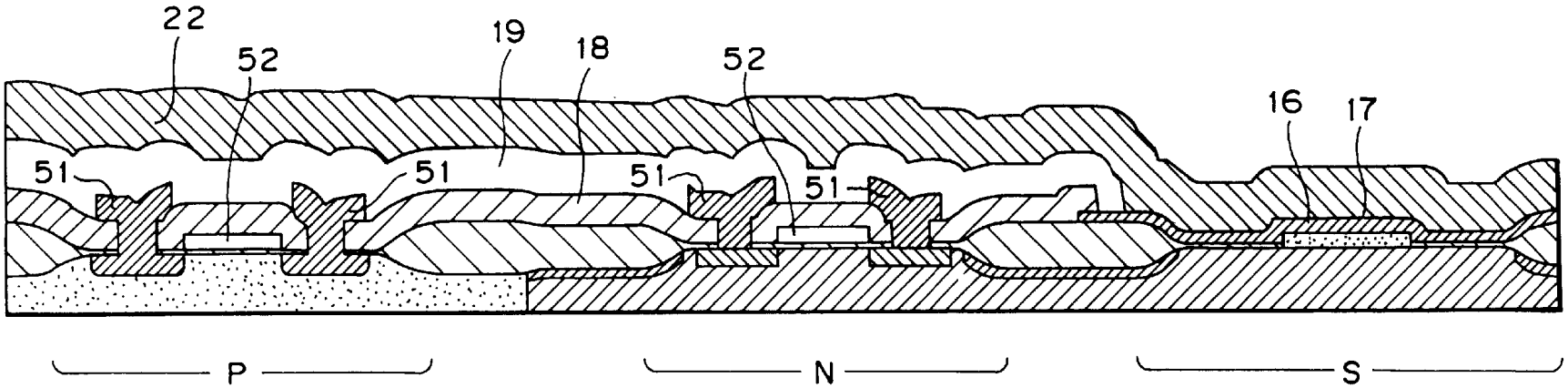
FIG. 13B is a schematic cross sectional view of a substrate including semiconductor devices for an inkjet head under construction, corresponding to FIG. 13A.

(11) As shown in FIG. 13A, a silicon nitride membrane 22 as a protective layer is formed up to 2,000 to 12,000 Å by plasma CVD. Then, Ta membrane 22 of 500 to 6,000 Å in thickness for an anti-cavitation is formed by a spattering method and then subjected to patterning to make a predetermined pattern. Then, the protective membrane 22 is processed into a pattern of electrode 50 draw out. FIG. 13B is a schematic cross sectional view of a substrate for inkjet head under construction, corresponding to FIG. 13A. In the figure, "S" denotes a portion to be formed as an ink-supplying opening, "P" denotes a portion of "PMOS", and "N" denotes a portion of "NMOS". In the present invention, "PMOS" and "NMOS" make up a CMOS transistor as a functional element for supplying an electric signal to be applied on an electro-thermal transducer that generates a thermal energy to be used for ejecting ink. The CMOS transistor is manufactured using the step of manufacturing the portion "S" to be provided as an ink-supplying opening in addition to the step of manufacturing the conventional IC. In the figure, furthermore, the reference numeral "51" denotes an electrode made of aluminum and "52" denotes an electrode made of polysilicon.

(12) Subsequently, ink-ejection orifices are formed by the conventional method (for example, see Japanese Patent Application Laying-open No. 10-181032 (1998)). In FIG. 14, a groove to be provided as a through hole is formed from the back of the Si substrate 1 by an anisotropic etching. In the figure, reference numeral 24 is a path-forming layer to be provided as a path when it is removed at a subsequent step, reference numeral 25 is a nozzle-forming layer. Furthermore, reference numeral 26 is a mask material of anisotropic etching. Then, the poly-Si membrane is removed from the back of the Si wafer and thus the field oxidation membrane is remained.

The shape of anisotropically-etched portion of the Si substrate has a reversed taper portion which is formed substantially near the DZ of the back of the Si substrate.

If an etching solution comes into contact with oxygen precipitates, impurities and crystal defects which are gettered by the oxygen precipitates during the process of etching the Si substrate 1, an anisotropic etching proceeds without depending on crystal orientation and the etching rate at these contacted points increases several folds to few hundred folds compared with other portions. Then, the etching further proceeds to both of the surface and the back of the Si substrate from a crystal plane (1, 0, 0) which is exposed again by the proceeding of etching, so that the reversed taper portion is generated between an area where the oxygen precipitates, and the gettered impurities and crystal defects are being present and another area without any of them.

For the anisotropic etching, a width 27 of the ink-supplying opening is 140 to 160 $\mu$m and an opening width 28 of the backmask is 500 to 800 $\mu$m. These values include all of the variations in a wafer, in between wafers, and in a semiconductor device. However, the above dimensions should be optionally selected depending on the specifications of the product and also depending on a thickness of the Si substrate and an oxygen concentration.

The etching solution used in the anisotropic etching is a tetramethyl ammonium hydroxide(TMAH) aqueous solution at an etching temperature of 80 to 90° C. for 15 to 20 hours when a thickness of the Si substrate is about 625 $\mu$m.

(13) Following the completion of anisotropic etching, a chemical vapor deposition (hereinafter referred to as "CVD") membrane being present in an ink-supplying opening is removed by a dry-etching using fluorine or oxygen gas. Then, an nozzle-forming agent 24 comprising an organic resin positioned at a portion to be formed as an ink passage is leaked and removed by a solvent. Consequently, as shown in FIG. 15, a semiconductor device having an inkjet recording capability can be obtained. An inkjet head equipped with the semiconductor device shows sufficient operating characteristics (e.g., operating frequencies of the inkjet head, refill characteristics of ink, and print qualities of the inkjet head).

The semiconductor device thus obtained shows a density of defects caused by oxygen precipitates (OP) in a layer having oxygen precipitates (OP) is $5\times10^{8}$ to $1\times10^{10}$ $cm^{-3}$ and a size of the defect is 50 $\mu$m or less. Accordingly, ink-supplying openings can be formed on the semiconductor device with a high degree of precision. It means that variations in their dimensions are very small, so that it is possible to extensively improve performance capabilities of the inkjet head (e.g., operating frequencies of the inkjet head, refill characteristics of ink, and print qualities of the inkjet head).

We are now explaining an inkjet head on which the semiconductor device having an inkjet recording capability is equipped.

Figure 16:
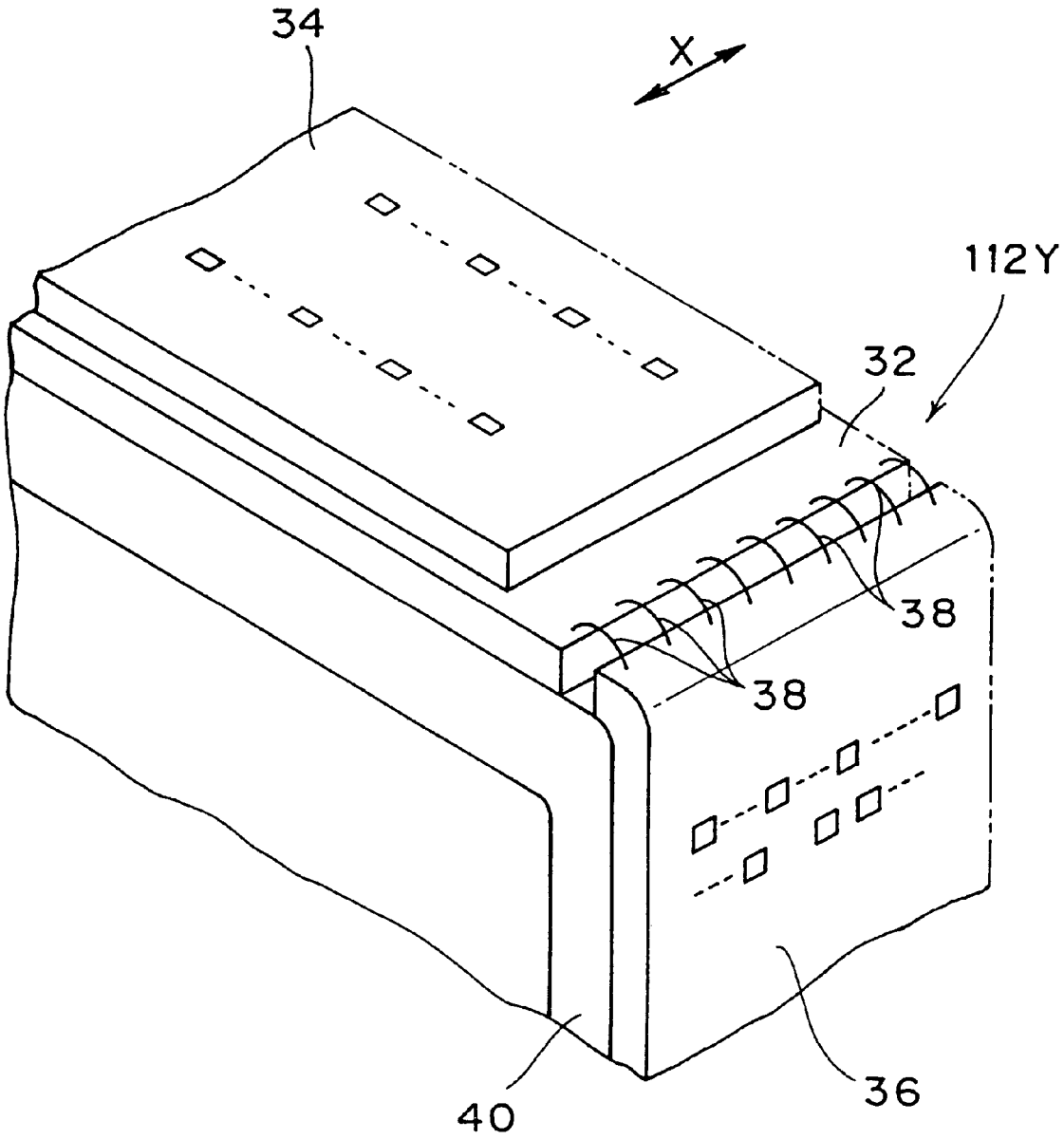
FIG. 16 is a perspective view of an example of the inkjet head in accordance with the present invention.

FIG. 16 is a perspective view of an inkjet head as one of the preferred embodiment of the present invention. The inkjet head 112Y comprises a driving substrate 32 fixed on a sub ink tank 40 provided as an ink reservoir; an orifice plate member 34 on the driving substrate 32 as a surface portion on which ink-ejection orifices are formed; and an electrode plate member 36 being electrically connected with the driving substrate 32 through a plurality of wires 38.

Figure 17:
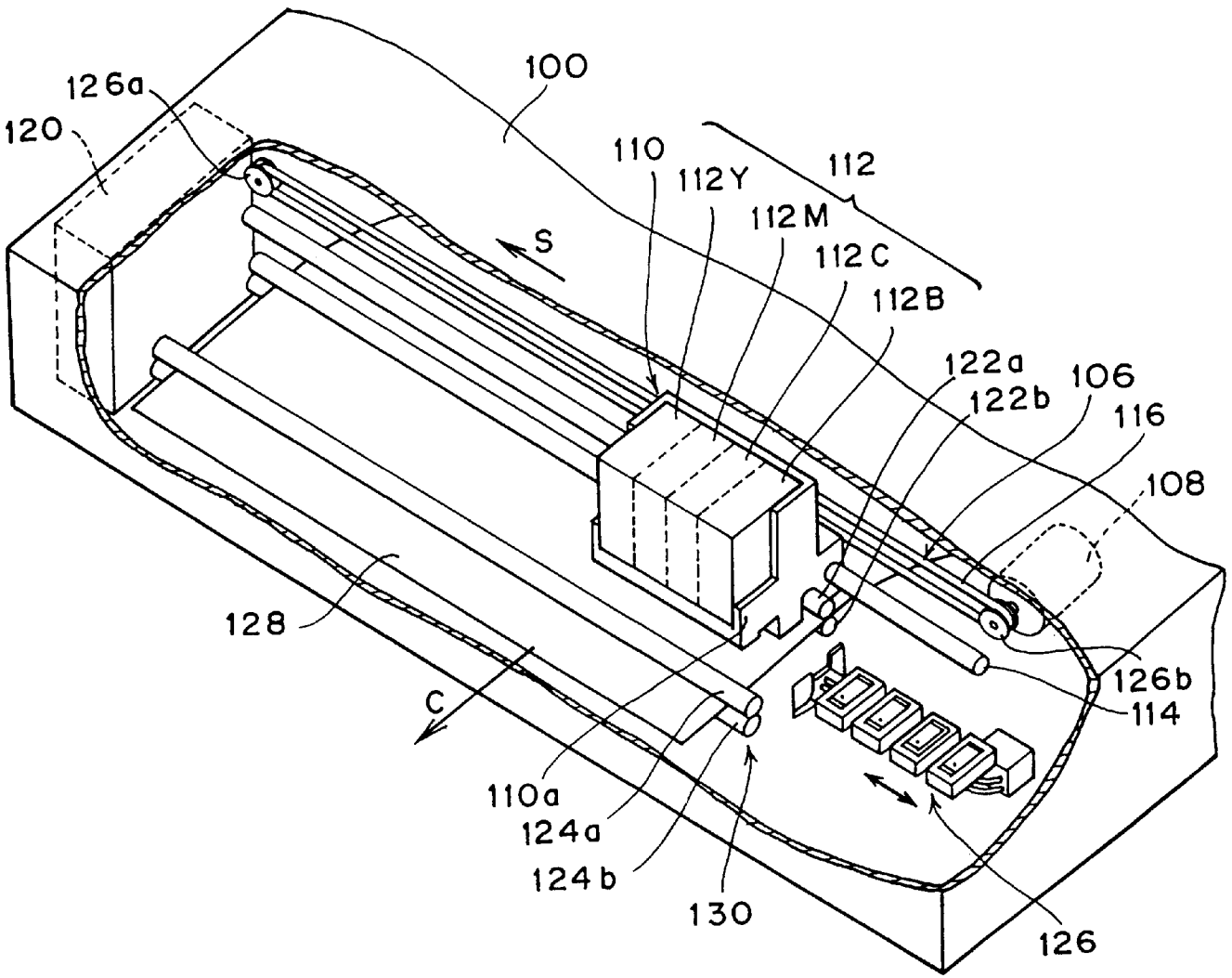
FIG. 17 is a partial cross sectional perspective view of an example of the inkjet printer in accordance with the present invention.

The inkjet head can be detachably mounted on an inkjet printer shown in FIG. 17.

The inkjet printer comprises a transfer device for intermittently transferring a sheet of paper as a recording medium 128 in the direction of the arrow C; a recording portion 110 that performs a reciprocating motion in parallel with the direction perpendicular to the transferring the recording medium 128; and a driving portion 106 for moving the recording portion 110.

The transferring device 130 comprises a pair of roller units 122*a* and 122*b*, a pair of roller units 124a and 124*b*, and a driving portion 120. These roller units are being positioned in parallel with each other. If the driving portion 120 is activated, the recording medium 128 is intermittently transferred by sandwiching between the roller units 122*a* and 122*b* and between the roller units 124*a* and 124*b*.

The driving portion 106 for moving the recording portion 110 comprises: pulleys 126*a* and 126*b* provided on the respective shafts which face to each other with a predetermined space; a belt 116 putting around these pulleys 126*a* and 126*b;* a guide shaft 114 which is positioned in parallel to roller units 122*a* and 122*b* to guide the movement of a carriage member 100*a* of the recording portion 110; and a motor 118 that moves the belt 116 connecting to the carriage member 110 in the forward or reverse direction.

If the belt 116 rotates in the direction indicated by the allow "S" in FIG. 17 by the motor, the carriage member 110*a* shifts its position for a predetermined distance in the direction of the allow "S". If the belt 116 rotates in the opposite direction of the allow "S", the caarriae member 110*a* shifts its position for a predetermined distance in the opposite direction of the allow "S". Furthermore, there is a recovery unit 126 for performing an ejectrion recovery processing of the recording portion 110 is provided at a position (i.e., a home position of the carriage member 110*a*) on one end portion of the driving portion 106. The recovering unit 126 faces to an array of ink-ejecting orifices of the recording portion 110.

The recording portion 110 comprises an inkjet head 112Y for yellow, an inkjet head 112M for magenta, an inkjet head 112C for cyan, and an inkjet head 112B for black. Each of the inkjet heads can be connected to a removable ink tank of the corresponding color. As shown in the figure, the carriage member 110*a* holds the ink tanks in a removable manner.

According the present invention, as described above, a semiconductor device having an inkjet recording capability is manufactured by forming ink-supplying openings almost over a chip by performing an anisotropic etching from the back of the chip, where variations in the widths of ink-supplying openings in the chip, in the wafer, or in between the wafers are very small. Thus, the ink-supplying openings can be formed with stability, so that operating characteristics (e.g., operating frequencies of the inkjet head, refill characteristics of ink, and print qualities of the inkjet head) of the inkjet head equipped with the semiconductor device can be extensively improved.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A semiconductor device having an inkjet recording capability, comprising:

a silicon substrate having a denuded zone (DZ) and an oxygen precipitate (OP) region, where the OP region contains oxygen precipitates (OPs);

energy-generating elements for generating energy for ejecting ink, which are formed on the silicon substrate;

ink-supplying openings provided as through-holes formed on the silicon substrate;

ink-flow channels provided in a layer of forming flow channels being stacked on the silicon substrate, communicating with the ink-supplying openings and corresponding to the energy-generating elements, respectively; and ink-ejecting orifices provided in a layer of forming orifices being stacked on the layer of forming flow channels, communicating with the ink-flow channels, respectively, wherein a size of each defect caused by the oxygen precipitates (OPs) in the OP region is 50 $\mu$m or less.

2. The semiconductor device as claimed in claim 1, wherein the denuded zone (DZ) is separated as two DZ portions, where one is provided as a surface portion of the silicon substrate and the other is provided as a back portion of the silicon substrate and each of them has a thickness of 30 to 150 $\mu$m.

3. The semiconductor device as claimed in claim 1, wherein a density of defects caused by the oxygen precipitates (OPs) in the OP region is $5\times10^{8}$ to $1\times10^{10}$ $cm^{-3}$.

4. The semiconductor device as claimed in claim 1, wherein the denuded zone (DZ) is formed by performing at least a step of high-temperature treatment in an intrinsic-gettering (IG) treatment process having the steps of high-temperature treatment and low-temperature treatment on the Si substrate.

5. The semiconductor device as claimed in claim 4, wherein the step of high-temperature treatment includes a high-temperature treatment at a temperature of 1,100° C. to 1,200° C.

6. The semiconductor device as claimed in claim 5, wherein the step of the low temperature treatment is performed at a temperature of 650° C. to 850° C.

7. The semiconductor device as claimed in claim 4, wherein the Si substrate is given the low-temperature treatment of the process of intrinsic-gettering (IG) treatment.

8. The semiconductor device as claimed in claim 1, wherein the ink-ejecting energy generating element is an electro-thermal energy converting element which can cause film boiling of the ink.

9. An inkjet head comprising a semiconductor device having an inkjet recording capability, the semiconductor device comprising:

a silicon substrate having a denuded zone (DZ) and an oxygen precipitate (OP) region, where the OP region contains oxygen precipitates (OPs);

energy-generating elements for generating energy for ejecting ink, which are formed on the silicon substrate;

ink-supplying openings provided as through-holes formed on the silicon substrate;

ink-flow channels provided in a layer of forming flow channels being stacked on the silicon substrate, communicating with the ink-supplying openings and corresponding to the energy-generating elements, respectively; and ink-ejecting orifices provided in a layer of forming orifices being stacked on the layer of forming flow channels, communicating with the ink-flow channels, respectively, wherein a size of each defect caused by the oxygen precipitates (OPs) in the OP region is 50 $\mu$m or less.

10. The inkjet head as claimed in claim 9, wherein the denuded zone (DZ) is separated as two DZ portions, where one is provided as a surface portion of the silicon substrate and the other is provided as a back portion of the silicon substrate and each of them has a thickness of 30 to 150 $\mu$m.

11. The inkjet head as claimed in claim 9, wherein a density of defects caused by the oxygen precipitates (OPs) in the OP region is $5\times10^{8}$ to $1\times10^{10}$ $cm^{-3}$.

12. The inkjet head as claimed in claim 9, wherein the denuded zone (DZ) is formed by performing at least a step of high-temperature treatment in an intrinsic-gettering (IG) treatment process having the steps of high-temperature treatment and low-temperature treatment on the Si substrate.

13. The inkjet head as claimed in claim 12, wherein the step of high-temperature treatment includes a high-temperature treatment at a temperature of 1,100° C. to 1,200° C.

14. The inkjet head as claimed in claim 12, wherein the Si substrate is given the low-temperature treatment of the process of intrinsic-gettering (IG) treatment.

15. The inkjet head as claimed in claim 14, wherein the step of the low temperature treatment is performed at a temperature of 650° C. to 850° C.

16. The inkjet head as claimed in claim 9, wherein the ink-ejecting energy generating element is an electro-thermal energy converting element which can cause film boiling of the ink.

17. An inkjet recording apparatus comprising a means on which an inkjet head having a semiconductor device with an inkjet recording capability is detachably installed or fixed, the semiconductor device comprising:

a silicon substrate having a denuded zone (DZ) and an oxygen precipitate (OP) region, where the OP region contains oxygen precipitates (OPs);

energy-generating elements for generating energy for ejecting ink, which are formed on the silicon substrate;

ink-supplying openings provided as through-holes formed on the silicon substrate;

ink-flow channels provided in a layer of forming flow channels being stacked on the silicon substrate, communicating with the ink-supplying openings and corresponding to the energy-generating elements, respectively; and ink-ejecting orifices provided in a layer of forming orifices being stacked on the layer of forming flow channels, communicating with the ink-flow channels, respectively, wherein a size of each defect caused by the oxygen precipitates (OPs) in the OP region is 50 $\mu$m or less.

18. An information-processing system comprising at least an output means and a control means for controlling an operation of the output means, where the output means is an inkjet recording apparatus having a means on which an inkjet head having a semiconductor device with an inkjet recording capability is detachably installed or fixed, the semiconductor device comprising:

a silicon substrate having a denuded zone (DZ) and an oxygen precipitate (OP) region, where the OP region contains oxygen precipitates (OPs);

energy-generating elements for generating energy for ejecting ink, which are formed on the silicon substrate;

ink-supplying openings provided as through-holes formed on the silicon substrate;

ink-flow channels provided in a layer of forming flow channels being stacked on the silicon substrate, communicating with the ink-supplying openings and corresponding to the energy-generating elements, respectively; and ink-ejecting orifices provided in a layer of forming orifices being stacked on the layer of forming flow channels, communicating with the ink-flow channels, respectively, wherein a size of each defect caused by the oxygen precipitates (OPs) in the OP region is 50 $\mu$m or less.

19. The information-processing system as claimed in claim 18, wherein the information-processing system is selected from the group consisting of: copying machines, facsimile machines, printers, word processors, personal computers, and textile printing apparatuses.

20. A semiconductor substrate to be used in a semiconductor device having an inkjet recording capability, comprising:

a silicon substrate having a denuded zone (DZ) and an oxygen precipitate (OP) region, where the OP region contains oxygen precipitates (OPs);

energy-generating elements for generating energy for ejecting ink, which are formed on the silicon substrate; and ink-supplying openings provided as through-holes formed on the silicon substrate, wherein a size of each defect caused by the oxygen precipitates (OPs) in the OP region is 50 $\mu$m or less.

* * * * *

UNITED STATES PATENT AND TRADEMARK OFFICE

CERTIFICATE OF CORRECTION

PATENT NO. : 6,450,621 B1
DATED : September 17, 2002
INVENTOR(S) : Yukihiro Hayakawa It is certified that error appears in the above-identified patent and that said Letters Patent is hereby corrected as shown below:

Column 2,
Line 30, “substrate:” should read -- substrate; --.
Line 50, “plane” should read -- plan --.

Column 3,
Lines 21, 24 and 29, “is to” should read -- to --.
Line 23, “device;” should read -- device. --.
Line 25, “a an” should read -- an --.

Column 8,
Line 20, “been also” should read -- also been --.

Column 9,
Line 19, “through out” should read -- throughout --.

Column 10,
Line 18, “After-removing” should read -- After removing --.
Line 48, “A” (second occurrence) should read -- Å --.

Column 11,
Line 5, “50” should be deleted.

Column 12,
Line 36, “transferring” should read -- transferring of --.
Line 59, “caarriae” should read -- carriage --.
Line 62, “ejectrion” should read -- ejection --.

Signed and Sealed this

Thirtieth Day of September, 2003

JAMES E. ROGAN
*Director of the United States Patent and Trademark Office*